United States Patent [19]

Klein et al.

[11] 4,090,892

[45] May 23, 1978

[54] PERMANENT MAGNETIC MATERIAL WHICH CONTAINS RARE EARTH METALS, ESPECIALLY NEODYMIUM, AND COBALT PROCESS FOR ITS PRODUCTION AND ITS USE

[75] Inventors: Hans-Peter Klein, Nussbaumen; Hartmut Nagel, Baden, both of Switzerland

[73] Assignee: BBC Brown Boveri & Company Limited, Baden, Switzerland

[21] Appl. No.: 806,338

[22] Filed: Jun. 14, 1977

Related U.S. Application Data

[63] Continuation of Ser. No. 635,215, Nov. 25, 1975, abandoned.

[30] Foreign Application Priority Data

Jan. 14, 1975 Switzerland ..... 398/75

[51] Int. Cl.[2] ..... H01F 1/02

[52] U.S. Cl. ..... 148/103; 75/153; 148/31.57; 148/105

[58] Field of Search ..... 148/103, 105, 31.57, 148/101; 75/152

[56] References Cited

U.S. PATENT DOCUMENTS

| | | | |
|---|---|---|---|
| 3,682,716 | 8/1972 | Martin et al. | 148/31.57 |
| 3,821,035 | 6/1974 | Martin | 148/31.57 |
| 3,873,379 | 3/1975 | Yamakawa et al. | 148/103 |
| 4,003,767 | 1/1977 | Bacamann et al. | 148/105 |

OTHER PUBLICATIONS

Strnat, K.; Co-RE Alloys as Magnet Materials, in Cobalt; 36, Sep., 1967, pp. 133–143.

*Primary Examiner*—Walter R. Satterfield
*Attorney, Agent, or Firm*—Oblon, Fisher, Spivak, McClelland & Maier

[57] ABSTRACT

A permanent magnetic material has the composition $(MM_{1-x}ND_x)_{1-y}Sm_yCo_5$, in which $0.25 < x < 1{,}0 \leqq y \leqq 0.25$, and MM is a misch metal of the composition $Ce_\alpha La_\beta Pr_\gamma$ wherein the parameters $\alpha$, $\beta$, $\gamma$, satisfy the conditions $0.50 < \alpha < 0.70$ $0.22 < \beta < 0.45$ $0.00 < \gamma < 0.06$, and $\alpha + \beta + \gamma = 1.$

10 Claims, 2 Drawing Figures

PERMANENT MAGNETIC MATERIAL WHICH CONTAINS RARE EARTH METALS, ESPECIALLY NEODYMIUM, AND COBALT PROCESS FOR ITS PRODUCTION AND ITS USE

This is a continuation of application Ser. No. 635,215, filed Nov. 25, 1975 and now abandoned.

BACKGROUND OF THE INVENTION

1. Field of the Invention:

The present invention relates to a permanent magnetic material which contains rare earth metals, especially neodymium, and cobalt, to a process for its production and to a use for same.

2. Description of Prior Art:

Material of the above-mentioned type is known, for example, from the article by W. A. A. J. Velge and K. H. J. Buschow in Proc. IEE Conf. on Magn. Mat., pages 45–50, London 1967. According to FIG. 4 of this publication, the (La, Nd)$Co_5$ alloys mentioned there possess, according to the proportion of neodymium at room temperature, only a slight dependence of the coercitive field strength of ${}_IH_C$ on the temperature. Such an independence of the coercitive field strenght from termperature variations is very desirable when one uses permanent magnets, for example in electric motors. In addition to this, however, high values of the remanence $B_r$ and of the coercitive field strength ${}_IH_C$ are also frequently necessary prerequisites which the permaent magnetic material has to fulfill. (La, Nd)$Co_5$ alloys, however, even at room temperature, where the coercitive field strength is generally greater than at higher temperatures, only reach coercitive field strengths of at most 3kOe. In addition, the coercitive field strength of (La, Nd)$Co_5$ alloys decreases monotonically as the temperature rises, to an extent dependent upon their composition, even at temperatures which are only slightly above room temperature, so that a use of these alloys as permanent magnets at elevated temperatures, say at 300° C is without interest.

SUMMARY OF THE INVENTION

Accordingly, it is an object of the present invention to provide a permanent magnetic material which contains rare earth metals, especially neodymium, and cobalt, whose coercitive field strength ${}_IH_C$ above room temperature decreases only fairly slowly as the temperature rises, but which even at temperatures of up to 300° C still shows values of the coercitive field strength which permit use of the material in special fields of application, such as in places where coercitive field strengths of more than 2kOe are required at temperatures around 300° C, and which furthermore, can also be produced in an economical manner by a simple process.

Briefly, this and other objects of this invention as will hereinafter become clear from the ensuing discussion have been attained by providing a material having the composition $(MM_{1-x}Nd_x)_{1-y}Sm_yCo_5$, in which $0.25 < x < 1$, $0 \leqq y \leqq 0.25$ and MM represents mischmetal of the composition $Ce_\alpha La_\beta Pr_\gamma$, and the parameters $\alpha$, $\beta$ and $\gamma$ fulfill the conditions $$0.50 < \alpha < 0.70$$

$$0.22 < \beta < 0.45$$

$$0.00 < \gamma < 0.06 \text{ and } \alpha + \beta + \gamma = 1.$$

Such a material can be used for the production of permanent magnets with a more or less temperature-independent coercitive field strength between room temperature and 300° C. Since such a material in addition possesses a coercitive field strength of over 2kOe even at temperatures around 300° C, it is eminently suitable as a permanent magnetic material in the construction of electric motors. A particular advantage is also the favorable price of this material, since it can be produced solely from the cheap cerium mischmetal of neodymium and cobalt without the use of expensive samarium or with only a small addition thereof.

The process of this invention for the production of such a material comprises melting together $(1-x')(1-y)$ moles of cerium mischmetal of the composition $Ce_\alpha La_\beta Pr_\gamma Nd_\delta$, in which $$0.45 < \alpha < 0.65$$

$$0.20 < \beta < 0.40$$

$$0.00 < \gamma < 0.05$$

$$0.05 < \delta < 0.15 \text{ and } \alpha + \beta + \gamma + \delta = 1,$$

with $x'(1-y)$ moles of neodymium, 5 moles of cobalt and possibly $y$ moles of samarium, in which $0.20 < x' < 0.85$ and $0 \leqq y \leqq 0.25$.

BRIEF DESCRIPTION OF THE DRAWINGS

A more complete appreciation of the invention and many of the attendant advantages thereof will be readily attained as the same becomes better understood by reference to the following detailed description when considered in connection with the accompanying drawings, wherein.

DESCRIPTION OF THE PREFERRED EMBODIMENTS

Figure 1:
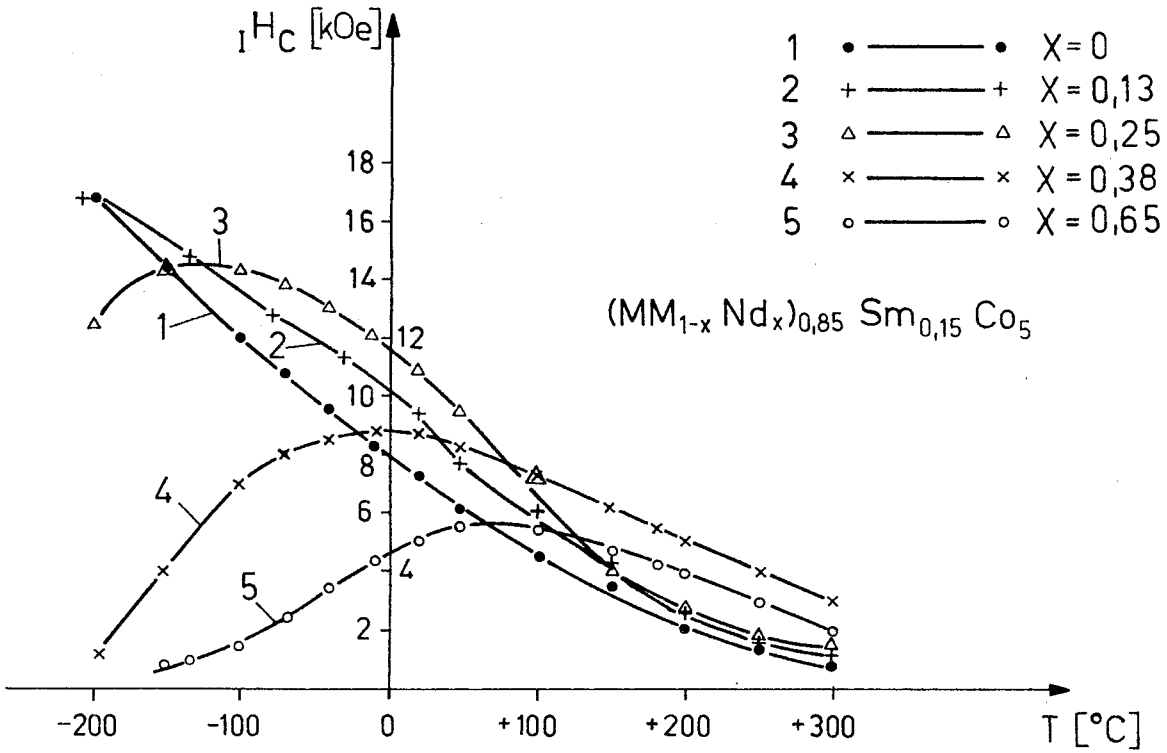
FIG. 1 shows the coercitive field strength ${}_IH_C$(kOe) of permanent magnetic materials of the composition $(MM_{1-x}Nd_x)_{0.85}Sm_{0.15}Co_5$, in which $x$ passes through the values 0; 0.13; 0.25; 0.38 and 0.65, depending upon the temperature T (° C)
Figure 2:
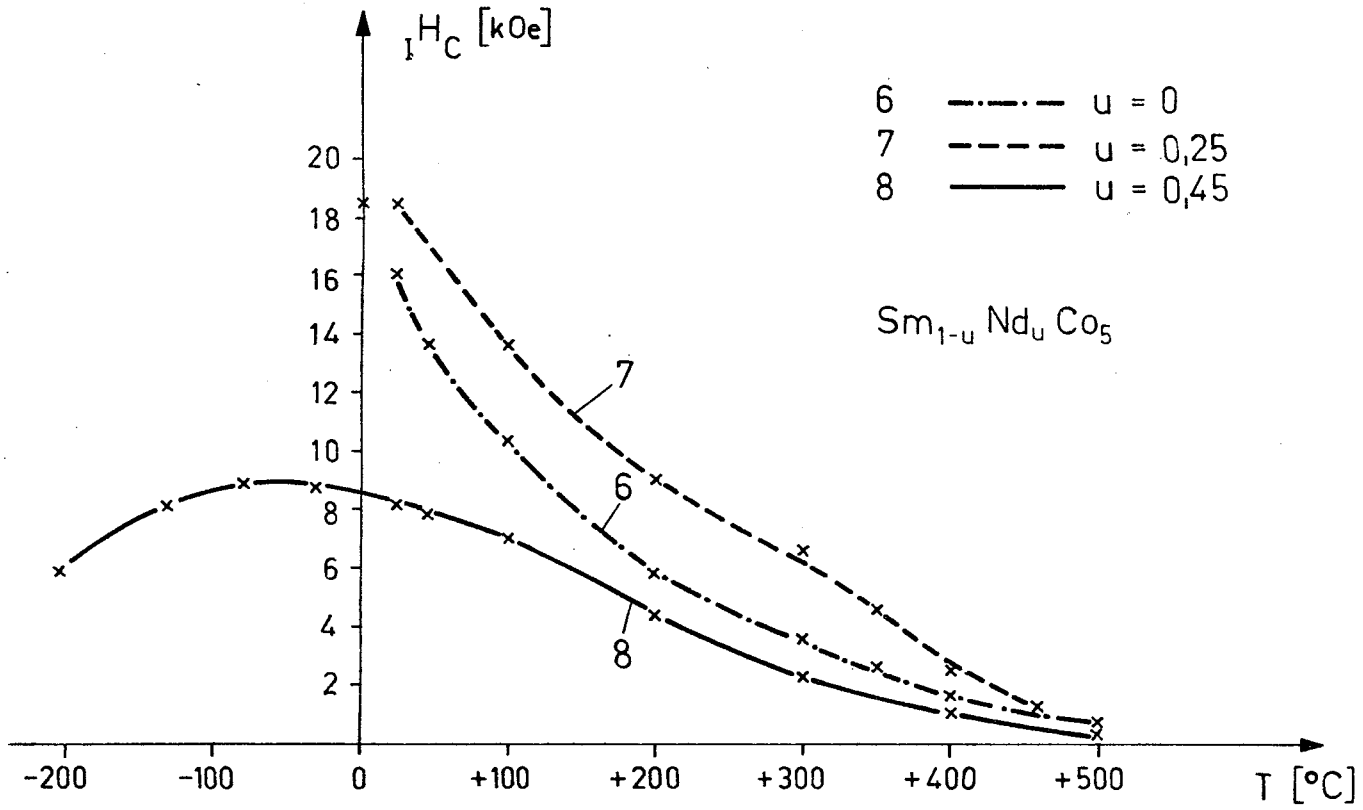
FIG. 2 shows the coercitive field strength ${}_IH_C$(kOe) of permanent magnetic material of the composition $Sm_{1-n}Nd_nCo_5$, in which $n$ passes through the values 0; 0.25; and 0.45, depending upon the temperature T (° C).

The materials of FIG. 1 in which $x = 0$ and 0.13, and also the materials of FIG. 2 are used only for comparison with the materials according to this invention, which are represented in FIG. 1 by the materials with $x = 0.25$; 0.38 and 0.65.

Having generally described the invention, a more complete understanding can be obtained by reference to certain specific examples, which are included for purposes of illustration only and are not intended to be limiting unless otherwise specified.

EXAMPLE 1

Permanent magnetic materials of the alloy series $(MM_{1-x}Nd_x)Co_5$, with $0 \leqq x \leqq 0.65$, were produced as follows:

1. $(Ce_{0.61}La_{0.34}Pr_{0.05})Co_5 = MM\ Co_5$ $(x = 0)$
2. $(MM_{0.87}Nd_{0.13})Co_5$ $(x - 0.13)$
3. $(MM_{0.75}Nd_{0.25})Co_5$ $(x = 0.25)$
4. $(MM_{0.62}Nd_{0.38})Co_5$: $(x = 0.38)$

5. $(MM_{0.35}Nd_{0.65})Co_5$: (x = 0.65)

In the alloys 1 – 5, the mixed metal, MM is $Ce_{0.61}La_{0.34}Pr_{0.05}$. Materials according to this invention are represented by the alloys 3 – 5. These alloys serve as initial alloys for further processing to form hard magnetic test bodies and still have no content of samarium, so that $y = 0$.

The alloy 1 was made by melting the elements cerium, lanthanum, praseodymium and cobalt weighed out in stoichiometrical proportions and possessing a purity of 99.9%.

The alloys 2 – 5, on the other hand, were made by melting the elements neodymium and cobalt weighed out in stoichiometrical proportions (purity in each case 99.9%) and from cerium mischmetal whose composition had been determined to within 1% by means of an X-ray fluorescence spectrometer, and which showed 53 atom percent of cerium, 30 atom percent of lanthanium, 13 atom percent of neodymium and 4 atom percent of praseodymium, All the initial alloys 1 – 5 were made molten in batches of 120 g each in a boron nitride crucible under an argon protective gas atmosphere with a medium frequency furnace at about 1200° C. The fused brittle initial alloys, after they had solidified and cooled to room temperature, were then ground into particles with diameters of less than 0.5 mm and then ground to a powder with a particle size between 2.5 and 4 μm in a counter jet mill. To these ground initial alloys there were then added powdered sinter additives consisting of an alloy containing 60 percent by weight of Sm and 40 percent by weight of cobalt (Sm 40 Co 60 alloy). The weight of this sinter additive varied between 10 and 14% of the total weight of the end product consisting of the initial alloy and the sinter additive. The initial alloy and the sinter additive were mixed and pressed at moderate pressure to form cylindrical test bodies, magnetically aligned in a magnetic field at about 50 kOe. isostatically pressed at 600 atmospheres and then sintered for at least 30 minutes at about 1040° C. After this, the test bodies were heat treated at 980° C for about 6 hours, rapidly cooled in argon or liquid nitrogen and then annealed at about 350° C for about 30 to 40 minutes.

In this way, test bodies were obtained of the following compositions:

1. $Ce_{0.52}La_{0.29}Pr_{0.04}Sm_{0.15}Co_5 = MM_{0.85}Sm_{0.15}Co_5$
2. $(MM_{0.87}Nd_{0.13})$ 0.85 $Sm_{0.15}Co_5$
3. $(MM_{0.75}Nd_{0.25})$ 0.85 $Sm_{0.15}Co_5$
4. $(MM_{0.62}Nd_{0.38})_{0.85}Sm_{0.15}Co_5$
5. $(MM_{0.35}Nd_{0.65})_{0.85}Sm_{0.15}Co_5$ once again with $MM = Ce_{0.61}La_{0.34}Pr_{0.05}$ The demagnetisation curves of these test bodies were then recorded after being subjected to pulses in an approximately 60 kOe magnetic DC field with a virbration magnetometer at a maxium field strength of 50 kOe.

In FIG. 1, the coercitive field strength $_JH_C$ of test bodies, which as described above, had been obtained by the addition of an Sm 40 Co 60 sinter additive to the powdered initial alloys 1 – 5 is plotted against the temperature T. From these curves one can see the marked dependence of the coercitive field strength $_JH_C$ at room temperature on the neodymium content. Thus the coercitive field strength of materials of the composition $(MM_{1-x}Nd_x)_{0.85}Sm_{0.15}Co_5$, above a neodymium proportion of x = 0.25 falls it is true continuously at room temperature. However, test bodies with a neodymium proportion $x = 0.38$ or $x = 0.65$ (numbers 4 and 5 of FIG. 1) have higher coercitive field strengths than other test bodies with a lower neodymium content at between 90° and 300° C or 150 ° and 300° C, respectively, and in addition, show the lowest dependence of the coercitive field strength on the temperature. The coercitive field strength $_JH_C = 5$ kOe of the test body with the neodymium proportion of $x = 0.65$ varied, between 0 and 170° C, for example, only by approximately ± 10%. A further advantage of the materials according to this invention with a neodymium proportion greater than 0.25 is that the remanence $B_r$ is higher and also less dependent on temperature, as compared with the Ca MM $Co_5$ alloy. From the demagnetisation curve of the test body with a neodymium proportion of $x = 0.65$ a remanence $B_r$ of 8.9 kg was recorded, which was approximately 10% higher than that of the test body of the alloy 2.

Instead of preparing the test bodies as described above, it is also possible to proceed as follows.

For example, it is also possible to mix size-reduced Ce MM $Co_5$, Nd $Co_5$ and Sm 40 Co 60 alloys followed by grinding them together in order to obtain the powder for the pressed bodies. In this case, as sinter additives one can use, as in the previously mentioned process, in addition to the Sm 40 Co 60 alloy other alloys such as Ce 40 Co 60, La 40 Co 60 or Nd 40 Co 60 alloys.

A further possibility of producing test bodies consists in first of all homogenising, with heat treatment at temperatures between 1150 and 1250° C, the alloys $(MM_{1-x}Nd_x)_{1-y}Sm_yCo_5$, in which $0.25 < x < 1$ and $0 \leqq y \leqq 0.25$, made by melting the components samarium, neodymium, cerium mischmetal and cobalt weighed out in stiochiometrical proportions. From these homogenised alloys it is then possible in a grinding device to produce spherical monocrystalline samples having a dimater of a few millimeters, which after pulses in a strong magnetic field can be tested for their magnetic properties in a magnetometer.

EXAMPLE 2

The superiority of the $MM_{1-x}Nd_xCo_5$ alloys, in which $x < 0.25$, in regard to the independence of the coercitive field strength on variations in temperatures above room temperature, and the highly advantageous nature of the choice of the alloys from the plurality of RE $Co_5$ alloys, in which RE represents one or more of the rare earth metals, can be seen from Example 2.

In this Example permanent magnets were produced from the following alloys:

6. Sm $Co_5$
7. $Sm_{0.75}Nd_{0.25}Co_5$
8. $Sm_{0.55}Nd_{0.45}Co_5$

From these alloys, test bodies were produced in a manner completely analogous to the first example and were tested for their magnetic properties in a magnetometer.

In FIG. 2, the coercitive field strength $_JH_C$ of these test bodies is plotted against the temperature T. From these curves, it is possible to see, in complete analogy to the curves of FIG. 1, a considerable decrease in the coercitive field strength at room temperature for a neodymium content x greater than 0.25. Nevertheless, with all the alloys the coercitive field strengths $_JH_C$ still depend very strongly on the temperature, because even in the case of the alloy 8 with a neodymium proportion of $x = 0.45$, the coercitive field strengths between room temperature and 170 or 300° C varied by 60 and 400% respectively, while in the case of the alloy 5 of the cerium mischmetal neodymium alloys (FIG. 1) the corresponding variations are only 10 and 200% respectively.

The advantages of the material $(MM_{1-x}Nd_x)_{1-y}Sm_yCo_5$, wherein $0.25 < x < 1$ described above are obtained with an MM of the composition $Ce_\alpha La_\beta Pr_\gamma$, in which $$0.50 < \alpha < 0.70$$

$$0.22 < \beta < 0.45$$

$$0.00 < \gamma < 0.06 \text{ and } \alpha + \beta + \gamma = 1,$$

and for a samarium proportion, $y$, of between 0 and 0.25.

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. A permanent magnetic material of the formula $(MM_{1-x}Nd_x)_{1-y}Sm_yCo_5$, in which, $0.38 \leqq x \leqq 0.65$, $0 \leqq y \leqq 0.25$, and MM of mischmetal of the composition $Ce_\alpha La_{62} Pr_\gamma$ wherein the parameters $\alpha$, $\beta$, $\gamma$ satisfy the conditions $$0.50 < \alpha < 0.70$$

$$0.22 < \beta < 0.45$$

$$0.00 < \gamma < 0.06, \text{ and } \alpha + \beta + \gamma = 1.$$

wherein the coercivity of permanent magnets prepared from said permanent magnetic material varies only ±10% between the temperatures of 0° – 170° C.

2. The material of Claim 1, wherein $\alpha$, $\beta$ and $\gamma$ possess the approximate values 0.61; 0.34 and 0.05, respectively.

3. The material of claim 1 having the composition $(MM_{1-x}Nd_x)_{0.85}Sm_{0.15}Co_5$, in which $0.38 \leqq x \leqq 0.65$.

4. A permanent magnetic material, of the formula: $(MM_{1-x}Nd_x)_{1-y}Sm_yCo_5$ wherein $$0.38 \leqq x \leqq 0.65;$$

$$0 \leqq y \leqq 0.25; \text{ and}$$

MM is a mischmetal of the composition $Ce_\alpha La\beta Pr_\gamma$, wherein $$0.50 < \alpha < 0.70$$

$$0.22 < \beta < 0.45$$

$$0.00 < \gamma < 0.06 \text{ and } \alpha + \beta + \gamma = 1.0$$

wherein the coercivity of permanent magnets prepared from said permanent magnetic material has a temperature dependency, $(\Delta_I H_C/\Delta T)$ (kOe/C°), of less than 0.02 in the range of 0° C $\leqq$ T $\leqq$ 300° C.

5. A permanent magnet made of the permanent magnetic material of claim 1 whose dependence of the coercitive field on the temperature $(\Delta_I H_C/\Delta T)$ (kOe/C°), in the range 0 $\leqq$ T $\leqq$ 300° C is less than 0.02

6. The permanent magnet of claim 5 having a coercitive field strength greater than 2 kOe at temperatures of up to 300° C.

7. A permanent magnet characterized by a coercive field having a temperature dependency, $(\Delta_I H_C/\Delta T)$ (kOe/C°), of less than 0.02 in the range of 0° C $\leqq$ T $\leqq$ 300° C, and prepared from the permanent magnetic material of claim 4.

8. A process for the production of the permanent magnetic material of claim 1, which comprises melting together $(1-x')$ $(1-y)$ moles of cerium mischmetal of the composition $Ce_\alpha La_\beta Pr_{65} Nd_\delta$, wherein $$0.45 < \alpha < 0.65$$

$$0.20 < \beta < 0.40$$

$$0.00 < \gamma < 0.05$$

$$0.05 < \delta < 0.15 \text{ and } \alpha + \beta + \gamma + \delta = 1,$$

$x'(1-y)$ moles of neodymium, 5 moles of cobalt and up to y moles of samarium; wherein $0.33 \leqq x' \leqq 0.50$ and $0 \leqq y \leqq 0.25$; wherein the coercivity of said permanent magnetic material varies only ±10% between the temperature of 0° – 170° C.

9. A method for achieving values of $_IH_C$ greater than 2 kOe at a temperature of up to 300° C and an $_IH_C$ characterized by a temperature dependency, $(\Delta_I H_C/\Delta T)$ (kOe/C°, of less than 0.02 in the range of 0° C $\leqq$ T $\leqq$ 300° C in permanent magnets prepared from magnetic materials of the formula:

$(MM_{1-x}Nd_x)_{1-y}Sm_yCo_5$, in which $0 \leqq y \leqq 0.25$, and MM is a mischmetal of the composition $Ce_\alpha La_\beta Pr_\gamma$ wherein:

$$0.50 < \alpha < 0.70$$

$$0.22 < \beta < 0.45$$

$$0.00 < \gamma < 0.06, \text{ and } \alpha + \beta + \gamma = 1,$$

which comprises adjusting the value of $x$ to $0.38 \leqq x \leqq 0.65$.

10. A process for the production of the permanent magnetic material of claim 4, which comprises melting together $(1-x')$ $(1-y)$ moles of cerium mischmetal of the composition $Ce_\alpha La_\beta Pr_\gamma Nd_\delta$, wherein $$0.45 < \alpha < 0.65$$

$$0.20 < \beta < 0.40$$

$$0.00 < \gamma < 0.05$$

$$0.05 < \delta < 0.15 \text{ and } \alpha + \beta + \gamma + \delta = 1;$$

$x'(1-y)$ moles of neodymium, 5 moles of cobalt and $y$ moles of Sm, wherein $0.33 \leqq x' \leqq 0.50$ and $0 \leqq y \leqq 0.25$; wherein the resulting permanent magnetic material has magnetic properties such that the coercive field of permanent magnets prepared from said permanent magnetic materials has a temperature dependency, $(\Delta_I H_C/\Delta T)$ kOe/C°, of less than 0.02 in the range of 0° C $\leqq$ T $\leqq$ 300° C.

* * * * *